United States Patent [19]

Ikeda et al.

[11] Patent Number: 4,764,091

[45] Date of Patent: Aug. 16, 1988

[54] PISTON TYPE COMPRESSOR FOR AIR CONDITIONING UNIT WITH ASYMMETRIC VALVE MECHANISMS

[75] Inventors: Hayato Ikeda; Hiroshi Onomura; Satoshi Kitahama, all of Kariya, Japan

[73] Assignee: Kabushiki Kaisha Toyoda Jidoshokki Seisakusho, Aichi, Japan

[21] Appl. No.: 2,307

[22] Filed: Jan. 9, 1987

Related U.S. Application Data

[63] Continuation-in-part of Ser. No. 937,340, Dec. 3, 1986.

[30] Foreign Application Priority Data

Dec. 5, 1985 [JP] Japan ..... 60-274108
Dec. 27, 1985 [JP] Japan ..... 60-299265
Jan. 13, 1986 [JP] Japan ..... 60-4661

[51] Int. Cl.[4] ..... F04B 27/08; F04B 39/10; F16K 15/16

[52] U.S. Cl. ..... 417/269; 417/571; 137/855

[58] Field of Search ..... 417/269, 559, 569, 571; 137/855, 856

[56] References Cited

U.S. PATENT DOCUMENTS 2,725,183 11/1955 Hanson ..... 137/856 X
2,868,443 1/1959 Dolza ..... 417/269 X
4,403,921 9/1983 Kato et al. ..... 417/296
4,642,037 2/1987 Fritchman ..... 417/571

FOREIGN PATENT DOCUMENTS 2755735 8/1978 Fed. Rep. of Germany ..... 417/559

*Primary Examiner*—Carlton R. Croyle
*Assistant Examiner*—Paul F. Neils
*Attorney, Agent, or Firm*—Burgess, Ryan & Wayne

[57] ABSTRACT

A piston type compressor having a cylinder block in which a plurality of compression chambers permit a plurality of pistons to be reciprocated so as to compress a refrigerant gas pumped from a suction chamber formed in an end housing into the compression chambers through suction ports of a valve plate, openably closed by a suction valve mechanism with a plurality of suction reed valves oscillatorily movable with regard to two bearing points, respectively, and to discharge the compressed refrigerant gas from the compression chambers into a discharge chamber formed in the end housing through discharge ports of the valve plate, openably closed by a discharge valve mechanism having a plurality of discharge reed valves oscillatorily movable with regard to two bearing points, respectively. The suction and discharge reed valves of the suction and discharge valve mechanisms are prevented suffering the effect of complicated and irregular vibrations by an asymmetrical arrangement of the suction and discharge ports of the valve plate with regard to bisectors perpendicular to lines connecting the respective two bearing points.

5 Claims, 5 Drawing Sheets

PISTON TYPE COMPRESSOR FOR AIR CONDITIONING UNIT WITH ASYMMETRIC VALVE MECHANISMS

CROSS-REFERENCE TO RELATED APPLICATION

This is a continuation-in-part application of copending U.S. patent application Ser. No. 937,340 filed Dec. 3, 1986.

BACKGROUND OF THE INVENTION

1. Field of the Invention

The present invention relates to a piston type compressor with an improved valve mechanism, adapted for use in a unit for air-conditioning a vehicle passenger compartment, and more particularly, to a piston type compressor with suction and discharge valve mechanisms free from irregular vibrations which cause noise in the air-conditioning circuit and abnormal resonances in the vehicle.

2. Description of the Related Art

Many piston type compressors, such as a swash plate type compressor and a wobble plate type compressor, are known. For example, U.S. Pat. No. 4,403,921 to Kato et al discloses a swash plate type compressor with double-acting reciprocatory pistons and suction and discharge valve mechanisms employing suction and discharge reed valves. The known swash plate type compressor of U.S. Pat. No. 4,403,921 includes a cylinder block having therein a plurality of cylinder bores serving as compression chambers for permitting double-acting pistons to be reciprocated therein to compress a refrigerant gas. The ends of the cylinder block are closed by front and rear housings, via valve plates, respectively, so that suction and discharge chambers are formed in each of the front and rear housings. The suction chambers are fluidly communicated with the compression chambers through suction ports formed in the valve plates and suction reed valves arranged on inner side of respective valve plates, and the discharge chambers are fluidly communicated with the compression chambers through discharge ports formed in the same valve plates and discharge reed valves arranged on an outer side of respective valve plates. The valve plates are also formed with inlet ports for permitting a refrigerant gas returning from the outer air-conditioning circuit to flow into the suction chambers, and outlet ports for permitting a compressed refrigerant gas to flow from the discharge chambers into the air-conditioning circuit.

With the above-described swash plate operated piston type compressor, the movement of the suction and discharge reed valves from the open position thereof apart from the valve plates to the closed position thereof in close contact with the valve plates, and vice versa, takes place in response to a pressure differential between the suction and discharge chambers and the compression chambers of the plurality of cylinder bores. Therefore, a change in the amount of the refrigerant gas throughout the air-conditioning circuit including the compressor as well as a change in a flow resistance of the gas pumped into the compression chambers from the suction chambers and discharged from the compression chambers into the discharge chambers during operation of the compressor, causes an abnormal vibration of the suction and discharge reed valves. The abnormal vibration of the valves is added to the normal oscillatory motions of the same valves, and as a result, complicated and irregular vibrations of the suction and discharge reed valves occur. The complicated vibrations are transmitted to an evaporator and a gas condenser in the air-conditioning circuit, via a suction gas piping and a discharge gas piping, and cause noise from the evaporator and the gas condenser.

Further, in recent light-weight cars, the body of the car per se is brought into a state of resonance with the vibrating evaporator and the condenser, and produces a resonant noise in the passenger compartment of the car.

SUMMARY OF THE INVENTION

An object of the present invention is to eliminate the above-mentioned defects encountered by the conventional piston type compressor with suction and discharge reed valves.

Another object of the present invention is to provide an improved valve mechanisms capable of preventing suction and discharge reed valves of a piston type compressor from being subjected to complicated and irregular vibrations which cause noise in the air-conditioning circuit incorporating the compressor.

A further object of the present invention is to provide a piston type compressor adapted to be used for forming a quiet air-conditioning system capable of being mounted on light weight vehicles.

In accordance with the present invention, there is provided a piston type compressor which includes: a cylinder block having therein a plurality of axial cylinder bores formed as compression chambers for permitting therein pistons to be reciprocated to compress a refrigerant gas; at least a housing closing an axial end of the cylinder block for forming a suction chamber receiving therein a refrigerant gas to be compressed and a discharge chamber for receiving a compressed refrigerant gas; a valve plate having an inlet port for introducing the refrigerant gas to be compressed from an outer air-conditioning circuit into the suction chamber, a suction port for fluidly communicating between the suction chamber and the compression chambers, an outlet port for discharging the compressed refrigerant gas from the discharging chamber toward the outer air-conditioning circuit, and a discharge port for fluidly communicating between the discharge chamber and the compression chambers; suction valve means arranged on one end face of the valve plate and having a base support plate in fixed close contact with the one end face of the valve plate and a plurality of suction reed valves formed integrally with the base support plate and adapted to perform an oscillatory movement with respect to two bearing points on the base support plate between a closing position in contact with the valve plate for closing the suction port and an opening position spaced apart from the valve plate for opening the suction port in response to a reciprocating motion of the pistons, each suction reed valve having a substantial length to define first and second planar portions on both sides of a lengthwise central axis thereof extending so as to pass through a point located at a middle position of the two bearing points and a center of the corresponding one of the suction ports; discharge valve means arranged on the other end face of the valve plate and having a base support plate in fixed close contact with the other end face of the valve plate and a plurality of discharge reed valve formed integrally with the base support plate and adapted to perform an oscillatory movement with regard to two bearing points on the base support plate between a closing position in contact with the valve plate for closing the discharge port and an opening position spaced apart from the valve plate for opening the discharge port in response to a reciprocating motion of the pistons, each discharge reed valve having a substantial length to define first and second planar portions on both sides of a lengthwise central axis thereof extending so as to pass through a point located at a middle position of the two bearing points and a center of the corresponding one of the discharge ports; and, means for subjecting a predetermined one of the first and second planar portions of each of at least either one of the plurality of suction and discharge reed valves to a larger displacement from the closing position upon each movement toward the opening position.

BRIEF DESCRIPTION OF THE DRAWINGS

The above and other objects, features and advantages of the present invention will become apparent from the ensuring description of the embodiments illustrated in the accompanying drawings wherein.

DESCRIPTION OF THE PREFERRED EMBODIMENTS

Figure 1:
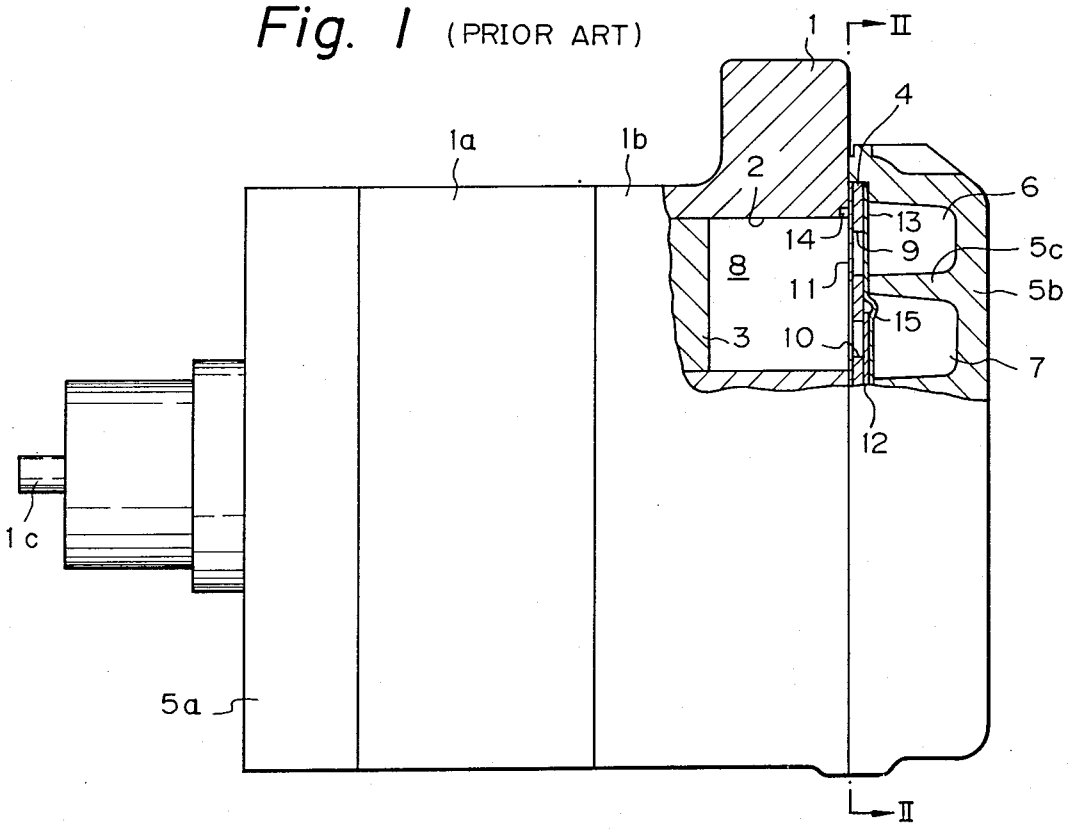
Fig. 1 (PRIOR ART)
FIG. 1 is a partly broken front view of a typical example of a swash plate-operated piston type compressor in which suction and discharge valve mechanisms, according to the present invention as well as the prior art can be equally accommodated.

Referring to FIG. 1, a swash plate-operated type compressor has a front and a rear cylinder block 1*a* and 1*b* combined together to form an integral cylinder block provided therein with a plurality of axial cylinder bores 2 arranged in parallel with a central axis of a drive shaft 1*c* on which a swash plate (not shown) is keyed. In the cylinder bores 2, double-acting pistons 3 are received so as to be reciprocated to compress a refrigerant gas returned from an outer air-conditioning circuit. The reciprocation of the piston 3 is caused by the rotation of the swash plate driven by the drive shaft 1*c*. An axial end of the front cylinder block 1*a* is closed by a front housing 5*a*, and an axial end of the rear cylinder block 1*b* is closed by a rear housing 5*b*. The front and rear housings 5*a* and 5*b* are connected to the corresponding axial ends of the cylinder blocks 1*a* and 1*b*, via valve plates (only the rear valve plate 4 is illustrated in FIG. 1). Each of the front and rear housings 5*a* and 5*b* includes therein a suction chamber for receiving a refrigerant gas to be compressed, and a discharge chamber for receiving a compressed refrigerant gas. Thus, the front side of the compressor assumes a half of the entire compression capacity and the rear side of the compressor assumes the remaining half.

FIG. 1 typically illustrates the inner construction of the rear side of the compressor. Note, a like construction is arranged in the front side of the compressor.

As illustrated in FIG. 1, the rear housing 5*b* forms therein a substantially annular suction chamber 6 and a substantially cylindrical discharge chamber 7, isolated from one another by a wall 5*c*. These suction and discharge chambers 6 and 7 are fluidly connectable to the outer air-conditioning circuit by means of suitable conduits. The valve plate 4 is formed with a plurality of suction ports for providing a fluid communication between the suction chamber 6 and the cylinder bores 2 serving as compression chambers, during the suction stroke of the pistons 3, and with a plurality of discharge ports 10 for providing a fluid communication between the discharge chamber 7 and the cylinder bores 2 during the discharge stroke of the piston 3. The valve plate 4 is also formed with a plurality of later-described inlet ports (not illustrated in FIG. 1) for permitting the refrigerant gas to flow into the suction chamber 6 when returned from the air-conditioning circuit, and at least one later-described outlet port (not illustrated in FIG. 1) for discharging the compressed refrigerant from the discharge chamber 7 toward the air-conditioning circuit 4. A suction valve disk 11 made of an elastic steel plate, such as a stainless steel plate 0.2 through 0.4 mm thick, is intervened between the axial end of the rear cylinder block 1*b* and an inner end face of the valve plate 4. A discharge valve disk 12 also made of an elastic steel plate, and a gasket 13 having later-described retainer portions 15, are intervened between an outer end face of the valve plate 4 and the rear cylinder block 5*b*.

Figure 2:
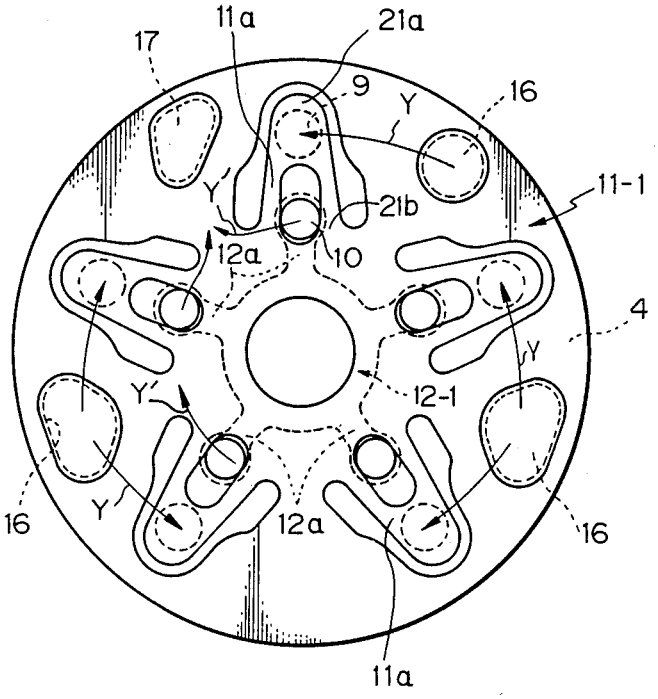
Fig. 2 (PRIOR ART)
FIG. 2 is a view taken along the line II—II of FIG. 1, illustrating the general arrangement of the suction and discharge valve mechanism of the prior art.

Referring to FIG. 2 illustrating the suction and discharge valve mechanisms of the prior art, the suction valve disk 11-1 of the prior art has a base support portion in fixed close contact with the inner end face of the valve plate 4 (FIG. 1), and a plurality (five in this example) of radially extended suction reed valves 11*a* angularly located in positions corresponding to the abovementioned suction ports 9. The suction reed valves 11*a* are formed integrally with the abovementioned base support portion. Each of the suction reed valves 11*a* has a free end 21*a* movable to an opening position, whereat it abuts against a recessed valve stop 14 (FIG. 1) of the cylinder block 1*b*, and a substantial length extending from a base portion 21*b* toward the free end 21*a* along a diametrical direction of the corresponding cylinder bores 2. Each suction reed valve 11*a* is also formed with a plurality of later-described elliptical openings, clearly illustrated in FIG. 2, in the base portion 21*b* so as to be in alignment with the discharge ports 10 of the valve plate 4. The base support portion of the suction valve disk 11-1 is formed with a plurality of inlet openings for introducing a refrigerant gas to be compressed into the suction chamber 6 through inlet ports 16 of the valve plate 4, and an outlet opening in alignment with an outlet port 17 of the valve plate 4.

The discharge valve disk 12-1 of the prior art is formed with a centrally annular base support portion, and a plurality (five in this example) of discharge reed valves 12*a* radially extending from the base support portion and angularly located in positions corresponding to the above-mentioned discharge ports 10. The centrally annular base support portion is in fixed close contact with the outer end face of the valve plate 4. The discharge reed valves 12*a* are free to move toward and away from the valve plate 4, and the movement of the discharge reed valves 12*a* from a closing position to close the discharge ports 10 to an opening position to open the ports 10 is limited by retainer portions 15 (FIG. 1) formed in the gasket 13. Formation of the suction and discharge valve disks 11-1 and 12-1 is achieved by a known press machine.

With the above-mentioned swash plate-operated piston type compressor of FIGS. 1 and 2, the refrigerant gas to be compressed flows into the suction chamber 6 of the rear housings 5*b*, via a swash plate chamber (not illustrated in FIGS. 1 and 2), suction passageways (not illustrated in FIGS. 1 and 2) formed between the angularly neighbouring cylinder bores 2 of the front and rear cylinder blocks 1*a* and 1*b*, and inlet ports 16 of the valve plate 4. The refrigerant gas in the suction chamber 6 is then pumped into the cylinder bores 2 to be compressed, via the suction ports 9 when opened by the suction reed valves 11*a*. Arrows "Y" in FIG. 2 indicate the typical flows of the refrigerant gas from the inlet ports 16 toward the suction ports 9. On the other hand, the refrigerant gas compressed by the pistons 3 is expelled from the cylinder bores 2 into the discharge chamber 7 of the rear housing 5, via the discharge ports 10 when opened by the discharge reed valves 12*a*. Arrows "Y'" in FIG. 2 indicate the flows of the compressed refrigerant gas flowing from the discharge ports 10 toward the outlet port 17 within the discharge chamber 7 of the rear housing 5*b*. The compressed refrigerant gas subsequently passes through the discharge passageways in the rear cylinder block 1*b*, and is then discharged to the outer air-conditioning circuit. The above-described suction and discharge of the refrigerant gas takes place similarly in the front side of the compressor.

At this stage, it should be noted that the movements of the suction and discharge reed valves 11*a* and 12*a* from the closing position to the opening position and, vice versa, occur in oscillatory motion manner, due to a pressure differential between the compression chambers of the cylinder bores 2 and the suction and discharge chambers 6 and 7 during the operation of the compressor, i.e., the rotation of the drive shaft 1*c*. Moreover, a change in the flow resistances of the suction and discharge refrigerant gas as well as a change in the amount of flow of the suction and discharge refrigerant gas have an adverse affect on the movements of the suction and discharge reed valves 11*a* and 12*a* of the suction and discharge reed valve disks 11-1 and 12-1. That is, FIGS. 3, 4A, and 4B diagrammatically illustrate irregular vibratory movements of the suction reed valve 11*a* of the suction valve disk 11-1.

Figure 3:
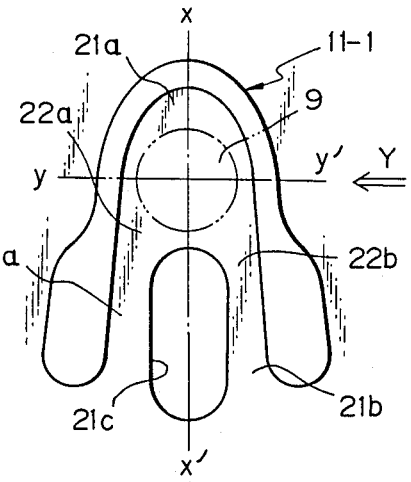
Fig. 3 (PRIOR ART)
FIG. 3 is a partial enlarged view of the suction valve mechanism of the prior art.
Figure 4A:
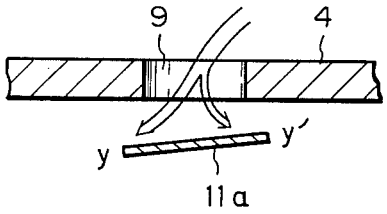
Fig. 4A (PRIOR ART)
FIGS. 4A and 4B are schematic cross-sectional views of the suction valve mechanism of the prior art, illustrating the unstable movement of the suction reed valve during the compressing operation of the piston type compressor.
Figure 4B:
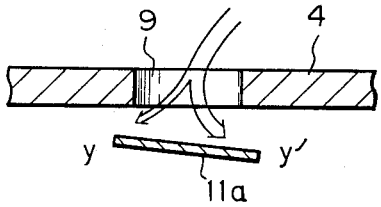
Fig. 4B (PRIOR ART)

As illustrated in FIG. 3, the suction reed valve 11*a* of the suction valve disk 11-1 is formed with an elliptical opening 21*c* at the base portion 21*b*, for permitting the compressed refrigerant gas to pass therethrough, and is formed so as to become narrower toward the free end 21*a*. The suction reed valve 11*a* has two symmetrical portions 22*a* and 22*b* with respect to a lengthwise central axis x-x' and is in register with the corresponding suction port 9 of the valve plate 4 (FIG. 1). An arrow "Y" in FIG. 3 corresponds to one of the arrows "Y" in FIG. 2, and indicates the flow of the refrigerant gas pumped into the suction port 9 along the line y-y' extending through the center of the suction port 9 and approximately perpendicular to the axis x-x'. Therefore, when the piston 3 carries out the suction stroke within the cylinder bore 2, the flow of the refrigerant gas is pumped into the cylinder bore 2 through the suction port 9 in response to the opening motion of the suction reed valve 11*a* while pressing the suction reed valve 11*a* toward the opening position. At that time, due to the symmetrical arrangement of the suction reed valve 11*a* per se and the suction port 9 with respect to the central axis x-x', the movements of the two symmetrical portions 22*a* and 22*b* change in an irregular and unstable manner as best illustrated in FIGS. 4A and 4B, no matter how small a change occurs in the flow characteristics of the refrigerant gas. The repetition of these irregular and unstable movements of the suction reed valve 11*a* appears an irregular vibrations of the suction reed valve 11*a* which are added to the regular oscillatory motions of the suction reed valve 11*a*. As a result, complicated vibratory movements of the suction reed valve 11*a* of the suction valve disk 11-1 take place, and are transmitted to an evaporator of the outer air-conditioning circuit as a complicated pulsation of the suction refrigerant gas, via a suction piping for conveying the refrigerant gas to be compressed. Similar complicated vibratory movements of the discharge reed valves 12*a* of the discharge valve disk 12-1 are transmitted to a gas condenser of the air-conditioning circuit as a complicated pulsation of the discharging refrigerant gas, via a discharge piping for conveying the compressed refrigerant. Consequently, the evaporator and the condenser of the air-conditioning circuit, which are liable to resonate with vibrations, produce noise. Particularly, in recent light weight cars, the car body per se resonantly produces noise which is perceived by a car passenger. In order to obviate such a noise problem, in a certain piston type compressor of the prior art, a muffling means having a size of 40 through 100 cubic centimeters is attached to the discharge end of the compressor. However, the attachment of the muffling means brings about diverse defects, such as a temperature rise, a high cost and an increase in the size of the compressor body.

The present invention provides improved suction and discharge valve mechanisms for a piston type compressor, as will be made apparent from the descriptions of the embodiment set forth below.

Figure 5A:
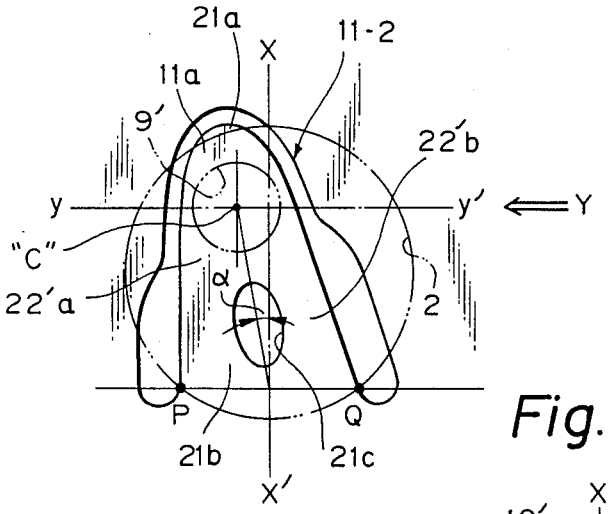
FIGS. 5A and 5B are partial enlarged views of suction and discharge valve mechanisms for the piston type compressor, according to an embodiment of the present invention, respectively.
Figure 5B:
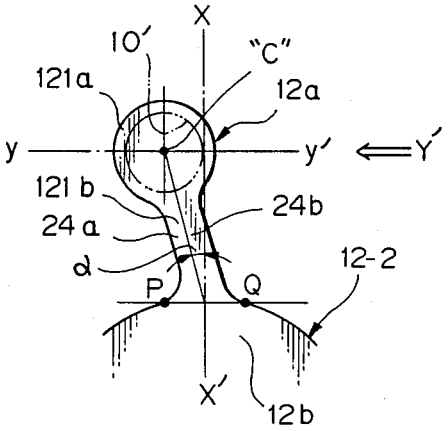

Referring to FIGS. 5A and 5B, which illustrate a suction valve mechanism for opening and closing a circular suction port 9' and a discharge valve mechanism for opening and closing a circular discharge port 10' according to the present invention, a suction valve disk 11-2 includes a plurality of suction reed valves 11*a* (one suction reed valve 11*a* is typically shown in FIG. 5A), which are integral with a base support plate portion 11*b*. The suction reed valve 11*a* bearing against the round edge of a cylinder bore 2 at two points P and Q on the base support plate portion 11*b*, is formed with an elliptical opening 21*c* at a base portion 21*b* for permitting the compressed refrigerant gas to pass therethrough, and is shaped so as to become narrower at a free end 21*a*. A discharge valve disk 12-2 includes a plurality of discharge reed valves 12*a* (one discharge reed valve 12*a* is typically shown in FIG. 5B) in the form having a circular head 121*a* for covering the corresponding discharge port 10' of the valve plate 4 (FIG.

1) and a planar neck portion 121*b* which is integral with a base support plate portion 12*b*. The planar neck portion 121*b* bears against the edge of the corresponding retainer portion of the gasket 13 (FIG. 1) at two bearing points P and Q on the base support plate portion 12*b*. Further, it should be noted that each of the suction and discharge reed valves 11*a* and 12*a* has a central axis thereof, which passes through a middle point between the above-mentioned bearing points P and Q toward a center C of the suction port 9' or discharge port 10' and deflected, by an angle $\alpha$, from a bisector X-X' perpendicular to a line connecting the two points P and Q. That is, the suction and discharge valves 11*a* and 12*a* extend obliquely outward from the base support plate portions 11*b* and 12*b* of the suction and discharge valve disks 11-2 and 12-2. An arrow Y in FIG. 5A indicates the flow of the refrigerant gas directed toward a suction port 9' within the suction chamber 6 (FIG. 1). An arrow Y' in FIG. 5B indicates the flow of the refrigerant gas directed from the discharge port 10' toward the outlet port 17 (FIG. 2) within the discharge chamber 7. Lines y-y' in FIGS. 5A and 5B perpendicular to the bisectors X-X' of the suction and discharge reed valves 11*a* and 12*a*, respectively, indicate the flowing directions of the refrigerant gas, respectively. The suction reed valve 11*a* has a first and a second portions 22'*a* and 22'*b* with respect to the central axis deflected from the bisector X-X', and the discharge reed valve 12*a* has also a first and a second planar portions 24*a* and 24*b* with respect to the central axis deflected from the bisector X-X'.

At this stage, according to the embodiment of the present invention, the round suction port 9' formed in the valve plate 4 is arranged aside the intersection of the bisector X-X' and the flowing direction Y-Y' of the refrigerant gas flow Y.

Similarly, the round discharge port 10' formed in the valve plate 4 is also arranged aside the intersection of the bisector X-X' and the flowing direction of the refrigerant gas flow Y'.

The shapes of the suction port 9' and the discharge port 10' are preferably round but not limited to the shown round shapes. That is, the shapes of the suction and discharge ports 9' and 10' may be polygonal or oval shapes, if symmetrical with respect to the center line of the suction or discharge reed valve 11*a* or 12*a*.

Figure 6:
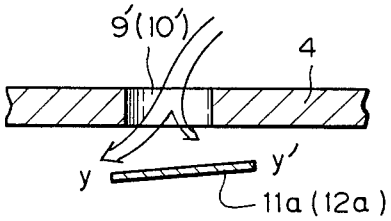
FIG. 6 is a schematic cross-sectional view of a suction and a discharge reed valves employed in the suction and discharge valve mechanisms of the embodiment of FIGS. 5A and 5B, illustrating the stable movement of the reed valves.

In accordance with the above-mentioned suction and discharge valve mechanisms of the present invention, the first and second planar portions 22'*a* and 22'*b* of the suction reed valve 11*a* are always subjected to different bending forces during the operation of the piston type compressor, i.e., the pumping (suction) stroke of the pistons 3 (FIG. 1). This is because when the suction force acts on the suction reed valve 11*a* via the suction port 9', it is concentrated approximately on the position of the suction reed valve 11*a* in alignment with the center C of the suction port 9' that is deflected from the intersecting point of the bisector X-X' and the line Y-Y' of the flowing direction toward the side of the bearing point P. Accordingly, the suction reed valve 11*a* is bent and moved from the closed position thereof to the opening position with respect to the refrigerant gas flow Y, in such a manner that the displacement of the first planar portion 22'*a* always tends to be larger than that of the second planar portion 22'*b* as illustrated in FIG. 6. As a result, the movement of the suction reed valve 11*a* of the suction valve disk 11-2 can be constant and regular so as to arrive at a constant open position, although slightly inclined as shown in FIG. 6.

The discharge port 10' of the valve plate 4 similarly brings about a constant and regular difference in the displacements of the first and second symmetrical planar portions 24*a* and 24*b* of the discharge reed valve 12*a*, as also shown in FIG. 6.

The above-described constant movements of the suction and discharge reed valves 11*a* and 12*a* contribute to preventing the occurrence of complicated and irregular vibrations of the suction and discharge reed valves 11*a* and 12*a* per se. That is, the movements of the suction and discharge reed valves 11*a* and 12*a* can be always regular oscillatory movements between the closing positions in contact with the valve plate 4 and the opening positions abutting against the valve stops 14 and 15. Consequently, the pulsations in the suction and discharge flows of the refrigerant gas caused by the suction and discharge valve mechanisms of the piston type compressor are effectively suppressed to the lowest level. Therefore, the level of noise produced by the evaporator and the gas condenser can be lowered. This also makes it possible to avoid the employment of a muffling means for noise suppression. As a result, a rise in the temperature of the compressed refrigerant gas, as well as an increase in the size of the piston type compressor per se, can be prevented.

Figure 7:
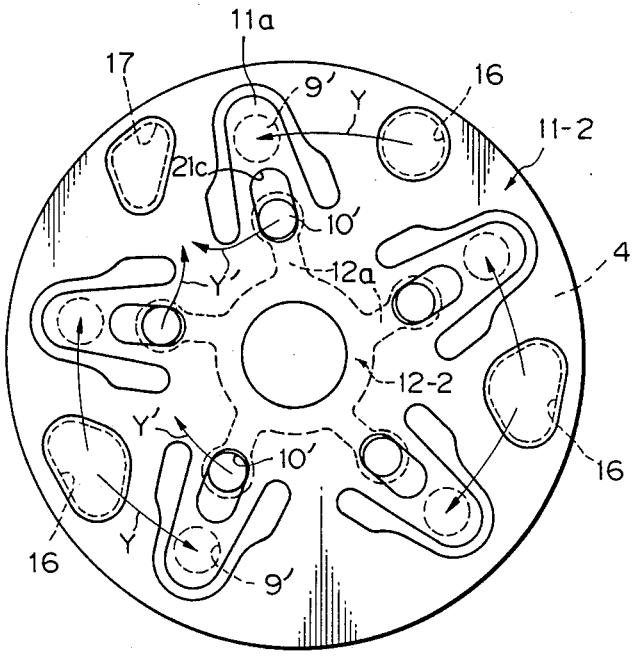
FIG. 7 is a view similar to FIG. 2, illustrating the whole arrangement of the suction and discharge valve mechanism, according to the embodiment of the present invention.

FIG. 7 illustrates the entire arrangement of the suction and discharge valve mechanism employing the suction and discharge reed valves 11*a* and 12*a* as described above and illustrated in FIGS. 5A and 5B. It will be understood that the plurality of suction and discharge reed valves 11*a* and 12*a* are formed so as to turn obliquely in the same circumferential direction around the center of the suction and discharge valve disks 11-2 and 12-2.

From the foregoing description of the preferred embodiment of the present invention, it will be understood that, according to the present invention, the piston type compressor, such as a swash plate type compressor and a wobble plate type compressor, can operate without suffering complicated and irregular vibrations of the suction and discharge valve mechanisms. Therefore, it is possible to suppress the noise level of the elements liable to resonate with mechanical vibrations, such as an evaporator and a gas condenser of the air-conditioning circuit, to the lowest level.

It should be understood that the above-described embodiment is directed to the case where the present invention is applied to both suction and discharge valve mechanisms of a piston type compressor, but an advantage of the present invention is that it may be applied to either one of the suction and discharge valve mechanisms.

We claim:

1. A piston type compressor comprising:

a cylinder block having therein a plurality of axial cylinder bores formed as compression chambers for permitting therein pistons to be reciprocated to compress a refrigerant gas;

at least a housing closing an axial end of the cylinder block for forming a suction chamber receiving therein a refrigerant gas to be compressed and a discharge chamber for receiving a compressed refrigerant gas;

a valve plate having an inlet port for introducing the refrigerant gas to be compressed from an outer air-conditioning circuit into the suction chamber, suction ports for fluidly communicating between the suction chamber and the compression chambers, an outlet port for discharging the compressed refrigerant gas from the discharging chamber toward the outer air-conditioning circuit, and discharge ports for fluidly communicating between the discharge chamber and the compression chambers;

suction valve means arranged on one end face of the valve plate and having a base support plate in fixed close contact with said one end face of the valve plate and a plurality of suction reed valves formed integrally with the base support plate and adapted to perform an oscillatory movement with respect to two bearing points on the base support plate between a closing position in contact with the valve plate for closing a corresponding one of said suction ports and an opening position spaced from the valve plate for opening the corresponding suction port in response to a reciprocating motion of the pistons, each suction reed valve having a substantial length to define a first and second planar portions on both sides of a lengthwise central axis thereof extending so as to pass through a point located at a middle position of said two bearing points and a center of said corresponding one of said suction ports;

discharge valve means arranged on the other end face of the valve plate and having a base support plate in fixed close contact with said other end face of the valve plate and a plurality of discharge reed valves formed integrally with the base support plate and adapted to perform an oscillatory movement with regard to two bearing points on the base support plate between a closing position in contact with the valve plate for closing a corresponding one of said discharge ports and an opening position spaced from the valve plate for opening the corresponding discharge port in response to a reciprocating motion of the pistons, each discharge reed valve having a substantial length to define a first and second planar portions on both sides of a lengthwise central axis thereof extending so as to pass through a point located at a middle position of said two bearing points and a center of said corresponding one of said discharge ports; and, wherein said lengthwise central axis of said each suction reed valve is arranged away from a bisector perpendicular to a line connecting said two bearing points on said base support plate of said suction valve means so as to form a first means for subjecting a predetermined one of said first and second planar portions of each of said plurality of suction reed valves to a larger displacement from said closing position in contact with said valve plate upon each movement toward said opening position.

2. A piston type compressor according to claim 1, wherein respective said lengthwise central axes of said plurality of said suction reed valve are arranged away from the respective bisectors perpendicular to the respective lines connecting respective said two bearing points on said base support plate of said suction valve means in a common circumferential direction around a center of said cylinder block having said plurality of axial cylinder bores which are angularly positioned around said center of said cylinder block.

3. A piston type compressor according to claim 1, wherein said lengthwise central axis of said each discharge reed valve is arranged away from a bisector perpendicular to a line connecting said two bearing points on said base support plate of said discharge valve means so as to form a second means for subjecting a predetermined one or said first and second planar portions of each of said plurality of discharge reed valves to a larger displacement from said closing position in contact with said valve plate upon each movement toward said opening position.

4. A piston type compressor according to claim 3, wherein respective said lengthwise central axes of each said plurality of said discharge reed valves are arranged away from the respective bisectors perpendicular to the respective lines connecting respective said two bearing points on said base support plate of said discharge valve means in a common circumferential direction around a center of said cylinder block having said plurality of axial cylinder bores which are angularly positioned around said center of said cylinder block.

5. A piston type compressor comprising:

a cylinder block having therein a plurality of axial cylinder bores formed as compression chambers for permitting therein pistons to be reciprocated to compress a refrigerant gas;

at least a housing closing an axial end of the cylinder block for forming a suction chamber receiving therein a refrigerant gas to be compressed and a discharge chamber for receiving a compressed refrigerant gas;

a valve plate having an inlet port for introducing the refrigerant gas to be compressed from an outer air-conditioning circuit into the suction chamber, suction ports for fluidly communicating between the suction chamber and the compression chambers, an outlet port for discharging the compressed refrigerant gas from the discharging chamber toward the outer air-conditioning circuit, and discharge ports for fluidly communicating between the discharge chamber and the compression chambers;

suction valve means arranged on one end face of the valve plate and having a base support plate in fixed close contact with said one end face of the valve plate and a plurality of suction reed valves formed integrally with the base support plate and adapted to perform an oscillatory movement with respect to two bearing points on the base support plate between a closing position in contact with the valve plate for closing a corresponding one of said suction ports and an opening position spaced from the valve plate for opening the corresponding suction port in response to a reciprocating motion of the pistons, each suction reed valve having a substantial length to define a first and second planar portions on both sides of a lengthwise central axis thereof extending so as to pass through a point located at a middle position of said two bearing points and a center of said corresponding one of said suction ports;

discharge valve means arranged on the other end face of the valve plate and having a base support plate in fixed close contact with said other end face of the valve plate and a plurality of discharge reed valves formed integrally with the base support plate and adapted to perform an oscillatory movement with regard to two bearing points on the base support plate between a closing position in contact with the valve plate for closing a corresponding one of said discharge ports and an opening position spaced from the valve plate for opening the corresponding discharge port in response to a reciprocating motion of the pistons, each discharge reed valve having a substantial length to define a first and second planar portions on both sides of a lengthwise central axis thereof extending so as to pass through a point located at a middle position of said two bearing points and a center of said corresponding one of said discharge ports; and, wherein respective said lengthwise central axis of each said plurality of said discharge reed valves are arranged away from the respective bisectors perpendicular to the respective lines connecting respective said two bearing points on said base support plate of said discharge valve means in a common circumferential direction around a center of said cylinder block having said plurality of axial cylinder bores which are angularly positioned around said center of said cylinder block.

* * * * *